US011769957B2

(12) United States Patent
Lin

(10) Patent No.: US 11,769,957 B2
(45) Date of Patent: Sep. 26, 2023

(54) ELECTRICAL CONNECTOR WITH METAL LATCH AND GROUNDING TERMINAL BRAZING SOLDERED TO THE SHIELD AND AND PRODUCT USING THE SAME

(71) Applicant: SHENZHEN DEREN ELECTRONIC CO., LTD., Shenzhen (CN)

(72) Inventor: Zongbiao Lin, Shenzhen (CN)

(73) Assignee: Shenzhen Deren Electronic Co., Ltd., Guangdong (CN)

( * ) Notice: Subject to any disclaimer, the term of this patent is extended or adjusted under 35 U.S.C. 154(b) by 314 days.

(21) Appl. No.: 17/273,253

(22) PCT Filed: Dec. 10, 2020

(86) PCT No.: PCT/CN2020/135207
§ 371 (c)(1),
(2) Date: Mar. 3, 2021

(87) PCT Pub. No.: WO2022/104950
PCT Pub. Date: May 27, 2022

(65) Prior Publication Data

US 2022/0360006 A1 Nov. 10, 2022

(30) Foreign Application Priority Data

Nov. 17, 2020 (CN) ..... 202011287566.9

(51) Int. Cl.
*H01R 12/73* (2011.01)
*H01R 13/6581* (2011.01)
(Continued)

(52) U.S. Cl.
CPC ..... *H01R 12/73* (2013.01); *H01R 13/6581* (2013.01); *H01R 4/029* (2013.01);
(Continued)

(58) Field of Classification Search
CPC .... H01R 12/73; H01R 13/6581; H01R 12/71; H01R 12/716; H01R 12/72;
(Continued)

(56) References Cited

U.S. PATENT DOCUMENTS 6,291,771 B1 * 9/2001 Tanikawa ..... B23K 20/106 174/84 R
9,843,136 B1 * 12/2017 Lin ..... H01R 12/724
(Continued)

FOREIGN PATENT DOCUMENTS

CN 2655442 Y 11/2004
CN 1871747 A 11/2006
(Continued)

OTHER PUBLICATIONS

International Search Report and Written Opinion from International Application No. PCT/CN2020/135207, dated Jun. 3, 2021.

*Primary Examiner* — Abdullah A Riyami
*Assistant Examiner* — Justin M Kratt
(74) *Attorney, Agent, or Firm* — Polsinelli PC

(57) ABSTRACT

The present application relates to an electrical connector and an electronic product. The electrical connector includes a metal terminal; an insulating body configured to fixing the metal terminal; a metal shield covering an outer side of at least a portion of the insulating body; a metal latch connected to the insulating body, and provided with a ground terminal thereon, and wherein the insulating body, the metal shield, and the metal latch enclose an accommodating space; and a brazing solder disposed at least partially within the accommodating space, and the brazing solder being configured to be melted during welding and to fixedly connect the metal shield and the metal latch after being cooled, such that the metal shield is electrically connect to the metal latch.

12 Claims, 4 Drawing Sheets

(51) Int. Cl.

| | |
|---|---|
| *H01R 12/71* | (2011.01) |
| *H01R 12/72* | (2011.01) |
| *H01R 13/6591* | (2011.01) |
| *H01R 13/6594* | (2011.01) |
| *H01R 13/6582* | (2011.01) |
| *H01R 4/02* | (2006.01) |
| *H01R 13/02* | (2006.01) |

(52) U.S. Cl.
CPC ..... *H01R 12/71* (2013.01); *H01R 12/716* (2013.01); *H01R 12/72* (2013.01); *H01R 12/721* (2013.01); *H01R 12/724* (2013.01); *H01R 13/02* (2013.01); *H01R 13/6582* (2013.01); *H01R 13/6591* (2013.01); *H01R 13/6594* (2013.01); *H01R 13/65914* (2020.08)

(58) Field of Classification Search
CPC ..... H01R 13/6582; H01R 13/65914; H01R 13/6594; H01R 12/724; H01R 13/6591; H01R 4/029; H01R 12/721; H01R 13/02
See application file for complete search history.

(56) References Cited

U.S. PATENT DOCUMENTS

| | | | |
|---|---|---|---|
| 2007/0249202 | A1 | 10/2007 | Ting |
| 2016/0352041 | A1 | 12/2016 | Yao et al. |

FOREIGN PATENT DOCUMENTS

| | | | |
|---|---|---|---|
| CN | 201112961 | Y | 9/2008 |
| CN | 103138117 | A | 6/2013 |
| CN | 203242847 | U | 10/2013 |
| CN | 204011986 | U | 12/2014 |

* cited by examiner

ELECTRICAL CONNECTOR WITH METAL LATCH AND GROUNDING TERMINAL BRAZING SOLDERED TO THE SHIELD AND AND PRODUCT USING THE SAME

CROSS REFERENCE TO RELATED APPLICATIONS

This application is a National Phase of International Application No. PCT/CN2020/135207 filed on Dec. 10, 2020 which claims priority to Chinese Patent Application No. 2020112875669, entitled "ELECTRICAL CONNECTOR AND ELECTRONICAL PRODUCT", filed to Chinese Patent Office, on Nov. 17, 2020, the entire content of which is incorporated herein in their entireties.

TECHNICAL FIELD

The present application relates to an electrical connector and an electronical product.

BACKGROUND

Electrical connectors are widely used in various fields. In practical applications, some electrical connectors are configured to transfer electrical energy from a power source to suitable power-consuming devices. Some electrical connectors are configured to interconnect signal transmission lines with printed circuit boards, other electronic devices, or other mating connectors.

Some electrical connectors are provided with shielding structures, grounding structures or the like to protect the electrical connectors. For example, some electrical connectors are provided with shielding structures to protect them from electrostatic discharge (ESD). In addition, the electrical connectors may be equipped with anti-electromagnetic interference (EMI) shielding structures. Essentially, the EMI shielding structure functions to protect a circuit from external radiation interference and to prevent electromagnetic interference from radiating to the outside of the electrical connector.

Typically, the ESD and EMI shielding structures are charged by stamped conductive metal plate components, and such conductive metal components typically cover an exterior of a housing of the electrical connector. Energized terminals of the ESD and EMI shielding structures typically join to ground terminals to achieve ground conduction.

SUMMARY

According to various embodiments of the present application, an electrical connector and an electronical product are provided.

An electrical connector includes:

a metal terminal;

an insulating body configured to fixing the metal terminal;

a metal shield covering an outer side of at least a portion of the insulating body;

a metal latch connected to the insulating body, and provided with a ground terminal thereon, and wherein the insulating body, the metal shield, and the metal latch enclose an accommodating space; and a brazing solder disposed at least partially within the accommodating space. The brazing solder is configured to be melted during welding and to fixedly connected to the metal shield and the metal latch after being cooled, such that the metal shield is electrically connect to the metal latch.

An electronic product includes an electrical connector as described above.

Details of one or more embodiments of the present application will be set forth in the following drawings and descriptions. Other features and advantages of the present application will become apparent from the specification, drawings, and claims.

BRIEF DESCRIPTION OF THE DRAWINGS

Hereinafter, specific embodiments of the present application will be described in further detail with reference to the accompanying drawings and embodiments. Apparently, the accompanying drawings in the following description are merely some embodiments of the present application, and other drawings may be obtained from these drawings without creative effort by one of ordinary skill in the art. In which.

Figure 1:
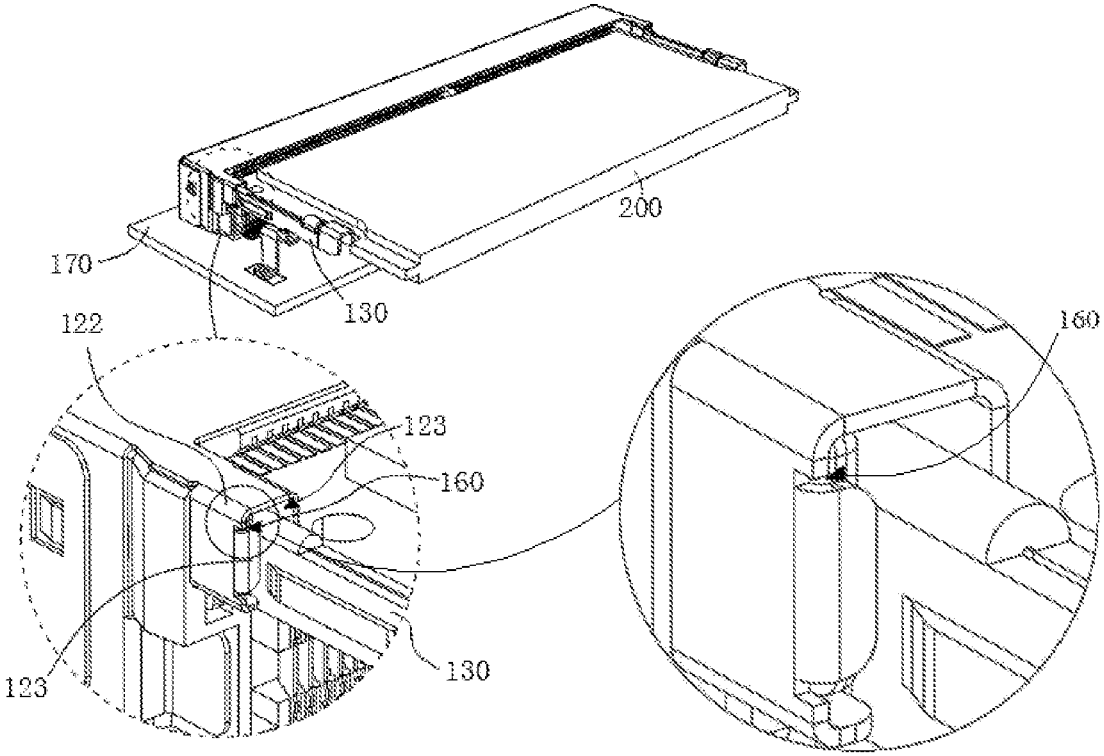
FIG. 1 shows a perspective schematic view of an electrical connector according to an embodiment of the present application.

Reference numerals: 110—insulating body, 120—metal shield, 121—shield body, 122—connecting portion, 123—inner cavity, 124—bending portion, 130—metal latch, 131—ground terminal, 132—latch body, 133—elastic stopper, 134—supporting portion, 140—brazing solder, 150—metal terminal, 160—accommodating space, 170—circuit board, 171—ground pad, 200—connectee component, 210—groove.

DETAILED DESCRIPTION OF THE EMBODIMENTS

A join-structure described in the background tends to have defects of poor contact.

In order to make the above objects, features and advantages of the present application more obvious and understandable, the specific embodiments of the present application will be illustrated in detail below in conjunctions with the accompanying drawings. In the following description, many specific details are set forth in order to assist a fully understanding of the present application. However, the present application can be implemented in many other ways than described herein, and those skilled in the art can make similar improvements without departing from the connotation of the present application. Therefore, the present application is not limited by the specific embodiments disclosed below.

FIG. 1 shows a schematic perspective view of an electrical connector according to an embodiment of the present application. The electrical connector is configured to be electrically connected to a connectee component 200 to achieve electrical conduction with the connectee component 200. After the electrical conduction is achieved, the electrical connector and the connectee component 200 may be used for current transmission, or signal transmission. Functions achieved by the electrical conduction are determined based on types of electrical connector and connectee component 200. For example, Universal Serial Bus (USB) is a common electrical connector that can be used for both current transmission, such as charging a mobile phone, and signal transmission, such as file transfer between a mobile phone and a computer.

Figure 2:
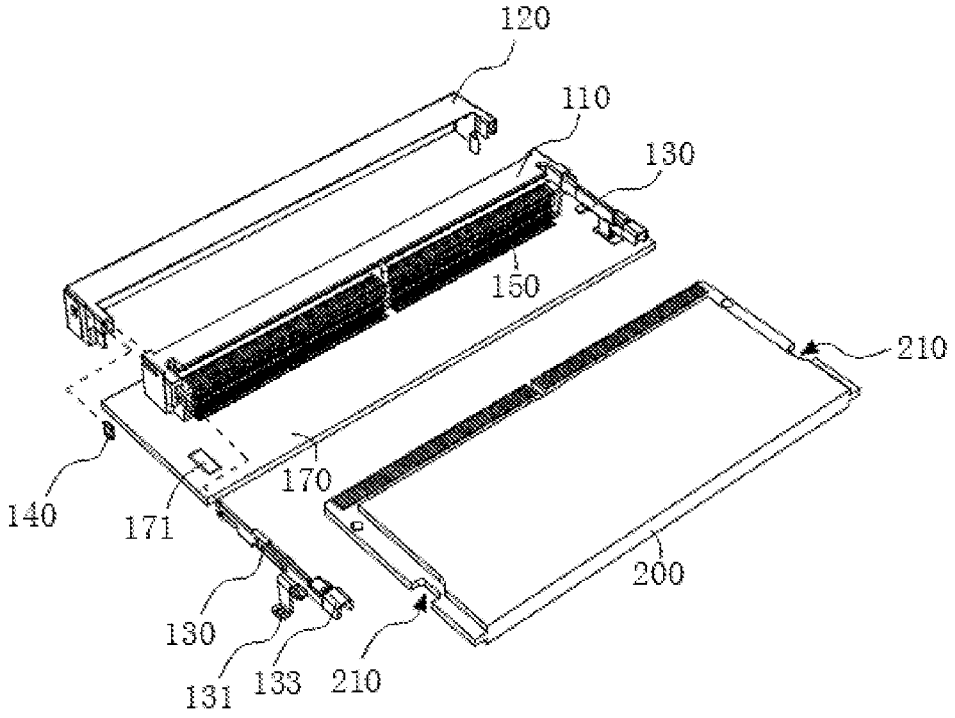
FIG. 2 is an exploded view of partial structure of the electrical connector shown in FIG. 1.

As shown in FIG. 2, FIG. 2 is an exploded view of partial structure of the electrical connector shown in FIG. 1. Referring to FIGS. 1 and 2, the electrical connector includes a metal terminal 150, an insulating body 110, a metal shield 120, a metal latch 130, and a brazing solder 140. The insulating body 110, the metal shield 120, and the metal latch 130 enclose an accommodating space 160 (as shown in FIG. 1). The metal terminal 150 is configured to be electrically connected to the connectee component 200 to be described later. The insulating body 110 is used for fixing the metal terminal 150. Specifically, the insulating body 110 is provided with a socket. The metal terminal 150 is provided in the socket. In one of the embodiments, the insulating body 110 may be made of a plastic material. In an embodiment, as shown in FIG. 1, the electrical connector further includes a circuit board 170. The insulating body 110 is fixedly connected to the circuit board 170. The metal terminal 150 is electrically connected to the circuit board 170.

The metal shield 120 covers an outer side of at least a portion of the insulating body 110 for resisting electromagnetic interference (EMI) or electrostatic discharge (ESD) of the electrical connector.

Figure 3:
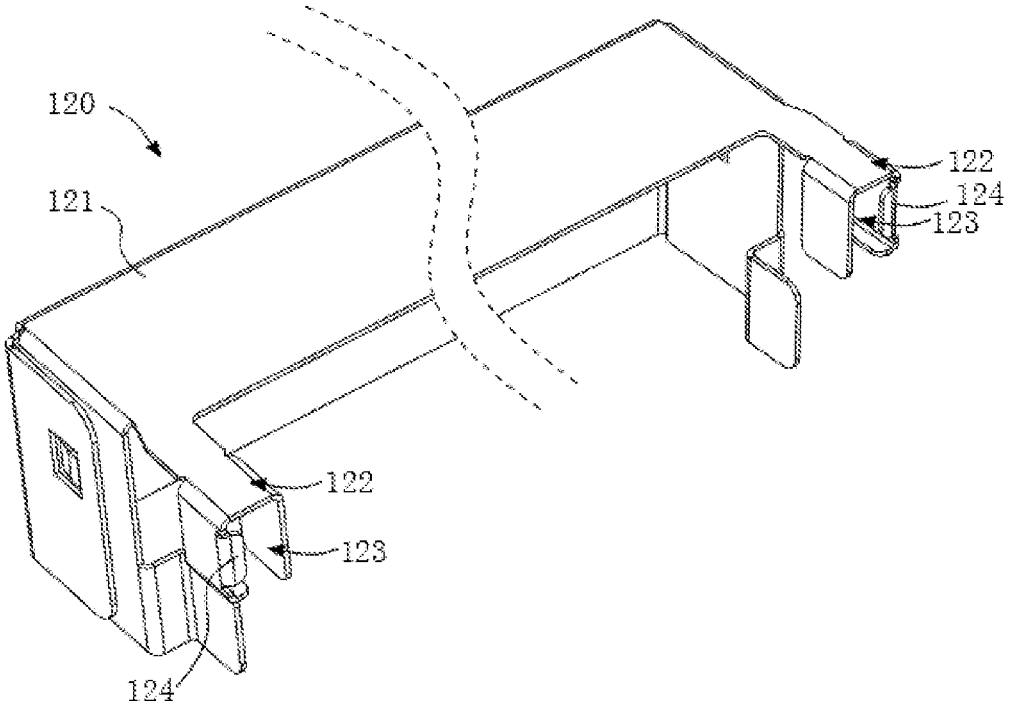
FIG. 3 is a perspective schematic view of a metal shield of an electrical connector according to an embodiment of the present application.

FIG. 3 is a perspective schematic view of a metal shield 120 of an electrical connector according to an embodiment of the present application. As shown in FIG. 3, the metal shield 120 includes a shield body 121 and a connecting portion 122 connected to the shield body 121. The shield body 121 may be substantially in an elongated shape. The connecting portion 122 is provided at an end of the shield body 121 in a length direction of the elongated shape. For example, the shield body 121 is provided with one connecting portion 122 at both ends in the length direction of the elongated shape. The entire metal shield 120 may be formed by bending or welding a metal sheet. The shield body 121 covers at least a portion of the insulating body 110. In one of the embodiments, the shield body 121 may completely cover the insulating body 110. In one of the embodiments, the shield body 121 may cover a portion of the insulating body 110. That is, in this case, the remaining part of the insulating body 110 can extend beyond a coverage area of the shield body 121. The connecting portion 122 is configured to be connected to the metal latch 130 to be described later.

As shown in FIG. 3, an inner cavity 123 is formed in the connecting portion 122. The inner cavity 123 may be provided for an insertion of at least a portion of the metal latch 130.

Figure 4:
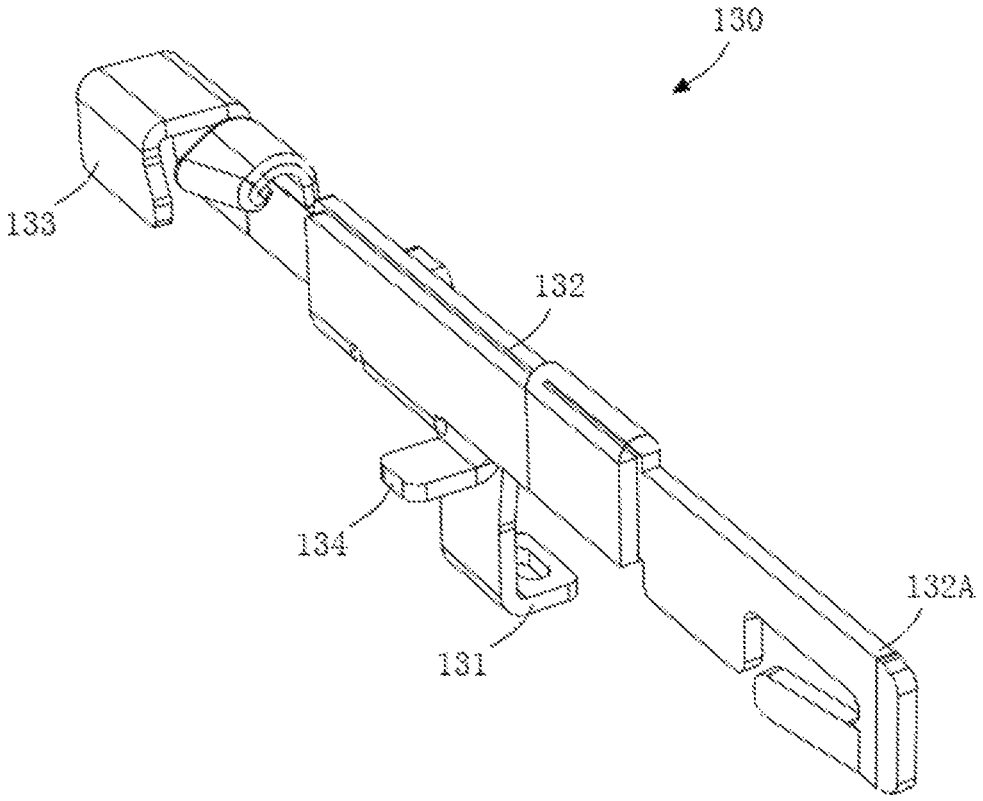
FIG. 4 is a perspective schematic view of a metal latch of an electrical connector according to an embodiment of the present application.

The metal latch 130 is connected to the insulating body 110. The metal latch 130 is provided with a ground terminal 131 thereon. In one of the embodiments, as shown in FIG. 2, the insulating body 110 is fixedly connected to the circuit board 170, the metal terminal 150 is electrically connected to the circuit board 170, and the circuit board 170 is provided with a ground pad 171 thereon. The ground terminal 131 of the metal latch 130 may be electrically connected to the ground pad 171. FIG. 4 is a perspective schematic view of a metal latch 130 of an electrical connector according to an embodiment of the present application. Specifically, as shown in FIG. 4, the metal latch 130 includes a latch body 132. At least a portion of the latch body 132 is inserted into the inner cavity 123. An inner wall of the inner cavity 123 and an outer wall of a portion of the latch body 132 into which the inner cavity 123 is inserted enclose the accommodating space 160. Specifically, the latch body 132 is substantially in an elongated shape. An end 132A of the latch body 132 in a length direction of the elongated shape is inserted into the inner cavity 123. An outer wall of the end 132A of the latch body 132 and an inner wall of the inner cavity 123 are spaced apart from each other to form the accommodating space 160 for accommodating the brazing solder 140. In other words, one lateral outer surface of the end 132A of the latch body 132 may be spaced apart from one lateral inner surface of the inner cavity 123 to form the accommodating space 160. For example, the accommodating space 160 may be formed in a portion of the inner cavity 123 in the length direction of the elongated shape of the shield body 121. In one of the embodiments, the accommodating space 160 may be flat.

The brazing solder 140 is disposed at least partially within the accommodating space 160. When the brazing solder 140 is placed into the accommodating space 160, both opposite surfaces of the brazing solder 140 may be attached to the outer wall of the end 132A of the latch body 132 and the inner wall of the inner cavity 123, respectively. In other words, both opposite surfaces of the brazing solder 140 may be attached to the one lateral outer surface of the end 132A of the latch body 132 and the one lateral inner surface of the inner cavity 123, respectively. When the brazing solder 140 is melted and solidified again, the brazing solder 140 may fixedly connect the outer wall (or the one lateral outer surface) of the end 132A of the latch body 132 and the inner wall (or the one lateral inner surface) of the inner cavity 123. That is, after the brazing solder 140 is melted, the connecting portion 122 and the metal latch 130 can be connected by the brazing solder 140. Therefore, the connecting portion 122 can be fixedly and electrically connected to the metal latch 130 by the brazing solder 140.

The brazing solder 140 is configured to be melted during welding and to fixedly connect the metal shield 120 and the metal latch 130 after being cooled, such that the metal shield 120 is electrically connect to the metal latch 130. In the embodiment shown in FIG. 2, the brazing solder 140 is a flat block structure and will be mounted within the accommodating space 160. It should be noted that the metal shield 120 and the metal latch 130 are separable when the brazing solder 140 is not melted. In this case, the metal shield 120 may be detached from the metal latch 130. In a subsequent processing process, the brazing solder 140 may be melted by a reflow process to fill the accommodating space 160 to a certain extent. The brazing solder 140 finally cools and solidifies, such that the metal shield 120 is electrically connected to the metal latch 130. In this case, the metal shield 120 is fixedly and electrically connected to the metal latch 130, which solves the problem of poor contact of a join between the conventional shield structure and the grounding portion.

The brazing solder 140 is confined within the accommodating space 160 by at least the metal shield 120 and the metal latch 130. When the electrical connector is assembled at an upstream manufacturer, and the brazing solder 140 may be melted to connect the metal shield 120 and the metal latch 130 at a downstream manufacturer. During transferring the electrical connector between the upstream manufacturer and the downstream manufacturer, since the brazing solder 140 is confined within the accommodating space 160, the brazing solder 140 is not released from the accommodating space 160, so that the brazing solder 140 is not easily lost.

When leaving the factory at the upstream manufacturer, the brazing solder 140 is already accommodated in the accommodating space 160, and after the electrical connector is obtained by the downstream manufacturer, the welding may be directly performed without providing a new brazing solder 140, thereby improving the working efficiency of the downstream manufacturer.

To further secure the brazing solder 140, as shown in FIG. 3, the metal shield 120 includes a bending portion 124. The connecting portion 122 is fixedly connected to the bending portion 124. In one of the embodiments, the connecting portion 122 is integrally formed with the bending portion 124. The bending portion 124 is provided to extend toward the latch body 132 when the metal latch 130 is inserted into the inner cavity 123 such that the outer wall (or the one lateral outer surface) of the metal latch 130 and the inner wall (or the one lateral surface) of the inner cavity 123 form the accommodating space 160 for accommodating the brazing solder 140, thereby confining the brazing solder 140 within the accommodating space 160. That is, the bending portion 124 extends toward the latch body 132 to close at least a portion of an opening of the accommodating space 160 such that the brazing solder 140 cannot be released from the accommodating space 160 through the opening.

As shown in FIGS. 1 and 2, the electrical connector is used for a detachably electrical connection with the connectee component 200. The connectee component 200 is provided with a groove 210. In order for the connectee component 200 to be firmly and stably connected to the electrical connector, the metal latch 130 further includes an elastic stopper 133 connected to the latch body 132. After the electrical connector is electrically connected to the connectee component 200, the elastic stopper 133 at least partially engages the groove 210. Thereby, the connectee component 200 is locked relative to the insulating body 110 of the electrical connector, thereby preventing the electrical connection between the electrical connector and the connectee component 200 from being in poor contact due to the detachment of the connectee component 200 from the insulating body 110. When it is desired to separate the connectee component 200 from the insulating body 110, the elastic stopper 133 may be moved to disengage the elastic stopper 133 from the groove 210.

As shown in FIG. 2, the connectee component 200 may be thin plate-shaped. An end of the thin plate-shaped connectee component 200 is electrically connected to the metal terminal 150. Specifically, since the metal terminal 150 is provided in the socket of the insulating body 110, the end of the thin plate-shaped connectee component 200 may be inserted into the socket to be electrically connected to the metal terminal 150. In a case where the end of the connectee component 200 is inserted into the socket of the insulating body 110, a large portion of the connectee component 200 is located outside the socket of the insulating body 110 and is suspended. In order to further secure and enhance the connection strength between the insulating body 110 and the connectee component 200, the metal latch 130 further includes a supporting portion 134 connected to the latch body 132, as shown in FIG. 4. The supporting portion 134 is configured to support the suspended portion of the connectee component 200. For example, the supporting portion 134 may support a bottom of the suspended portion of the connectee component 200.

In one of the embodiments, as shown in FIG. 2, at least two metal latches 130 may be provided. When the electrical connector and the connectee component 200 are assembled, the two metal latches 130 are respectively provided at both ends of the insulating body 110.

The present application further provides an electronic product including the electrical connector and the connectee component 200 in any of the embodiments as described above. The connectee component 200 is detachably electrically connected to the electrical connector.

In the description of the present application, it should be understood that orientation or positional relationships indicated by terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. are based on orientation or positional relationship shown in the drawings, which are merely to facilitate the description of the present application and simplify the description, not to indicate or imply that the device or elements must have a particular orientation, be constructed and operated in a particular orientation, and therefore cannot be construed as a limitation on the present application.

In addition, the terms "first" and "second" are used for description only, and cannot be understood as indicating or implying relative importance or implicitly indicating the number of technical features described. Thus, the features defined with "first" and "second" may include at least one of the features explicitly or implicitly. In the description of the present application, the meaning of "plurality" is at least two, such as two, three, etc., unless explicitly defined otherwise.

In the present application, unless explicitly specified and limited otherwise, the terms "mounting", "connecting", "connected", "fixed" and the like should be understood in a broad sense. For example, it may be a fixed connection or a detachable connection, or an integration, may be a mechanical connection or electrical connection, may be a direct connection, or may be an indirect connection through an intermediate medium, may be the connection between two elements or the interaction relationship between two elements, unless explicitly defined otherwise. The specific meanings of the above terms in the present application can be understood by one of those ordinary skills in the art according to specific circumstances.

In the present application, unless explicitly specified and limited otherwise, the first feature being "on" or "below" the second feature may be that the first and second features are in a direct contact, or the first and second features are in an indirectly contact through an intermediate medium. Moreover, the first feature being "over", "above" and "on" the second feature may be that the first feature is directly above or obliquely above the second feature, or simply means that the first feature is higher than the second feature in horizontal direction. The first feature being "beneath", "under", and "below" the second feature may be that the first feature is directly below or obliquely below the second feature, or simply means that the first feature is lower than the second feature in horizontal direction.

It should be noted that when an element is referred to as being "fixed" or "disposed on" another element, it may be directly on another element or there may also be an intermediate element therebetween. When an element is considered to be "connected" to another element, it may be directly connected to another element or there may be an intermediate element therebetween. As used herein, the terms "vertical", "horizontal", "upper", "lower", "left", "right", and similar expressions are for illustration only and are not meant to be the only embodiments.

The technical features of the above-mentioned embodiments can be combined arbitrarily. In order to simply the description, all possible combinations of the technical features in the above-mentioned embodiments are not described. However, as long as there is no contradiction in the combinations of these technical features, they should be considered to be fallen into the range described in the present specification.

Only several implementations of the present application are illustrated in the above-mentioned embodiments, and the description thereof is relatively specific and detailed, but it should not be understood as a limitation on the scope of the present application. It should be noted that for those of ordinary skill in the art, without departing from the concept of the present application, several modifications and improvements can be made, which all fall within the protection scope of the present application. Therefore, the protection scope of the present application shall be subject to the appended claims.

What is claimed is:

1. An electrical connector, comprising:

a metal terminal;

an insulating body configured for fixing the metal terminal;

a metal shield covering an outer side of at least a portion of the insulating body;

a metal latch connected to the insulating body, and provided with a ground terminal thereon, and wherein the insulating body, the metal shield, and the metal latch enclose an accommodating space; and a brazing solder disposed at least partially within the accommodating space, and the brazing solder being configured to be melted during welding and to be fixedly connected to the metal shield and the metal latch after being cooled, such that the metal shield is electrically connect to the metal latch.

2. The electrical connector according to claim 1, wherein the metal shield comprises a shield body and a connecting portion connected to the shield body, the shield body is configured to cover at least a portion of the insulating body, and the connecting portion is configured to be connected to the metal latch.

3. The electrical connector according to claim 2, wherein an inner cavity is formed on the connecting portion, the metal latch comprises a latch body, at least a portion of the latch body is inserted into the inner cavity, and an inner wall of the inner cavity and an outer wall of the latch body enclose the accommodating space.

4. The electrical connector according to claim 3, wherein the brazing solder is confined within the accommodating space by at least the metal shield and the metal latch.

5. The electrical connector according to claim 3, wherein the metal shield further comprises a bending portion connected to the connecting portion, the bending portion is provided to extend toward the latch body when at least a portion of the latch body is inserted into the inner cavity, thereby confining the brazing solder within the accommodating space.

6. The electrical connector according to claim 3, wherein the electrical connector is configured for a detachable electrical connection with a connectee component.

7. The electrical connector according to claim 6, wherein the connectee component is provided with a groove, the metal latch further comprises an elastic stopper connected to the latch body, after the electrical connector is electrically connected to the connectee component, the elastic stopper at least partially engages the groove.

8. The electrical connector according to claim 6, wherein the metal latch further comprises a supporting portion connected to the latch body, the supporting portion is configured to support the connectee component.

9. The electrical connector according to claim 8, wherein an end of the metal terminal is fixed in the insulating body, an end of the connectee component is inserted into the insulating body to be electrically connected to the metal terminal, the supporting portion is configured to support a portion of the connectee component located outside the insulating body.

10. The electrical connector according to claim 1, wherein the electrical connector further comprises a circuit board, the insulating body is fixedly connected to the circuit board, and the metal terminal is electrically connected to the circuit board, the circuit board is provided with a ground pad thereon, and the ground terminal is electrically connected to the ground pad.

11. The electrical connector according to claim 1, wherein at least two metal latches are provided.

12. An electronic product, comprising an electrical connector according to claim 1.

* * * * *